United States Patent [19]

Carroll et al.

[11] Patent Number: 5,058,809

[45] Date of Patent: Oct. 22, 1991

[54] FOAM GENERATING ASPIRATING NOZZLE

[75] Inventors: Daniel L. Carroll, Ankeny, Iowa; Timothy C. Shannon, Lexington, Tenn.

[73] Assignee: Delavan Inc., West Des Moines, Iowa

[21] Appl. No.: 579,852

[22] Filed: Sep. 7, 1990

[51] Int. Cl.[5] ..... E03C 1/084; A62C 31/12

[52] U.S. Cl. ..... 239/428.5; 169/15

[58] Field of Search ..... 169/14, 15; 239/343, 239/428.5

[56] References Cited

U.S. PATENT DOCUMENTS 2,423,618 7/1947 Ratzer ..... 261/116

2,761,516 9/1956 Vassilkovsky ..... 169/15

3,836,076 9/1974 Conrad et al. ..... 169/15 X

*Primary Examiner*—Margaret A. Focarino

*Assistant Examiner*—Andrew C. Pike

*Attorney, Agent, or Firm*—Lockwood, Alex, FitzGibbon & Cummings

[57] ABSTRACT

A foam generating nozzle and method of producing a high quality foam at high flowrates includes introducing a liquid foam producing agent to one end of an elongate passage in a nozzle body, introducing air to the flowing liquid in the elongate passage by aspirating the air through radially extending gas inlet passages having a first width adjacent the elongated passage and a second width greater than the first width adjacent the exterior of the body, and discharging the foam from the nozzle body.

26 Claims, 1 Drawing Sheet

FOAM GENERATING ASPIRATING NOZZLE

BACKGROUND AND SUMMARY OF THE INVENTION

The present invention relates to a foam generating nozzle and, more particularly, to a high flowrate foam generating aspirating nozzle which produces an improved quality of foam.

The foaming of liquid solutions has received wide attention over the years in several fields of application, including the agricultural and fire fighting fields, and in the cooling of hot materials. As to the latter application for example, foam generating nozzles have been employed to cool hot moving rolled steel because it has been discovered that foamed liquids exhibit increased cooling properties.

A wide variety of foam generating nozzles have been employed in the past with satisfactory results in a wide range of applications. Typical of such prior art nozzles which have generally enjoyed success in most applications are the nozzles and methods disclosed by Conrad et al. in U.S. Pat. No. 3,836,076. However, in certain foam applications, such as in the cooling of hot sheet steel, substantially increased cooling rates are needed, requiring increased liquid flowrates —— flowrate levels which are substantially greater than those encountered in most typical foam nozzle applications. At these substantially increased flowrates, it is generally necessary to increase the wall thickness of the nozzle body. When the nozzle body wall thickness is increased, the result is an increase in the length of the air aspirating passages through which the air is drawn into the nozzle body for intimate mixing with the liquid foam producing agent to produce the desired foam. This increase in air inlet aspirating passage length has been found to result in a substantial deterioration in the quality of the foam from the quality that is enjoyed in the lower flowrate foam generating nozzles.

In the present invention it has been discovered that, if the air aspirating passages which were typically of constant width in the past are tapered toward the exterior of the nozzle body so as to present a wider width adjacent the exterior, the quality of the foam which is generated by the nozzle is substantially improved.

In one principal aspect of the present invention, a foam generating nozzle comprises a nozzle body having an elongate passage therein and a liquid inlet adjacent one end of the elongate passage for introducing a liquid foam producing agent to flow axially through the elongate passage. At least one gas inlet passage extends through the nozzle body between the liquid inlet and the other end of the elongate passage for aspirating a gas into the passage when the liquid foam producing agent is flowing through the elongate passage. The gas inlet passage extends in a plane substantially perpendicular to the axis of the elongate passage and has a first width adjacent the elongate passage, a second width greater than the first width adjacent the exterior of the body, and a wall extending between those widths. The nozzle also includes foam discharge means adjacent the other end of the body for discharging the foam therefrom.

In another principal aspect of the present invention, the aforementioned liquid inlet comprises a pair of orifices for discharging liquid foam producing agent into the elongate passage so as to flow axially through the elongate passage and past the gas inlet passage, the pair of orifices being spaced radially from each other and from the axis of the elongate passage, and a pair of the gas inlet passages extending radially relative to the axis of the elongate passage and positioned transversely from the pair of orifices.

In still another principal aspect of the present invention, the aforementioned gas inlet passages comprise two portions, one portion extending radially outward from the elongate passage and having a width which is substantially constant over its length and that width is the aforementioned first width, and a second portion having the second width.

In still another principal aspect of the present invention, the aforementioned second portion comprises a wall which tapers between the first portion and the second width adjacent the exterior of the body.

In still another principal aspect of the present invention, a method of generating foam comprises discharging a liquid foam producing agent into an elongate passage to flow axially therein, flowing the liquid foam producing agent past a gas inlet passage which extends in a plane which is substantially perpendicular to the axis of the elongate passage and which has a wall which tapers between a first width adjacent the flowing liquid and a second width which is greater than the first width and which is spaced from the flowing liquid, and aspirating a gas into the flowing liquid foam producing agent through the tapered gas inlet passage to discharge the gas into the flowing liquid at the first width of the gas inlet passage.

In still another principal aspect of the present invention, in the foregoing nozzle and method the ratio of the first width of the gas inlet passage to the cross-sectional width of the elongate passage is approximately 0.17–0.23.

In still another principal aspect of the present invention, in the foregoing nozzle and method the ratio of the first width to the second width is approximately 0.3–0.5.

These and other objects, features and advantages of the present invention will become evident upon consideration of the following detailed description.

BRIEF DESCRIPTION OF THE DRAWING

In the course of this description, reference will frequently be made to the attached drawing in which.

DESCRIPTION OF THE PREFERRED EMBODIMENTS

Figures 1, 2, 2A, 3, 4:
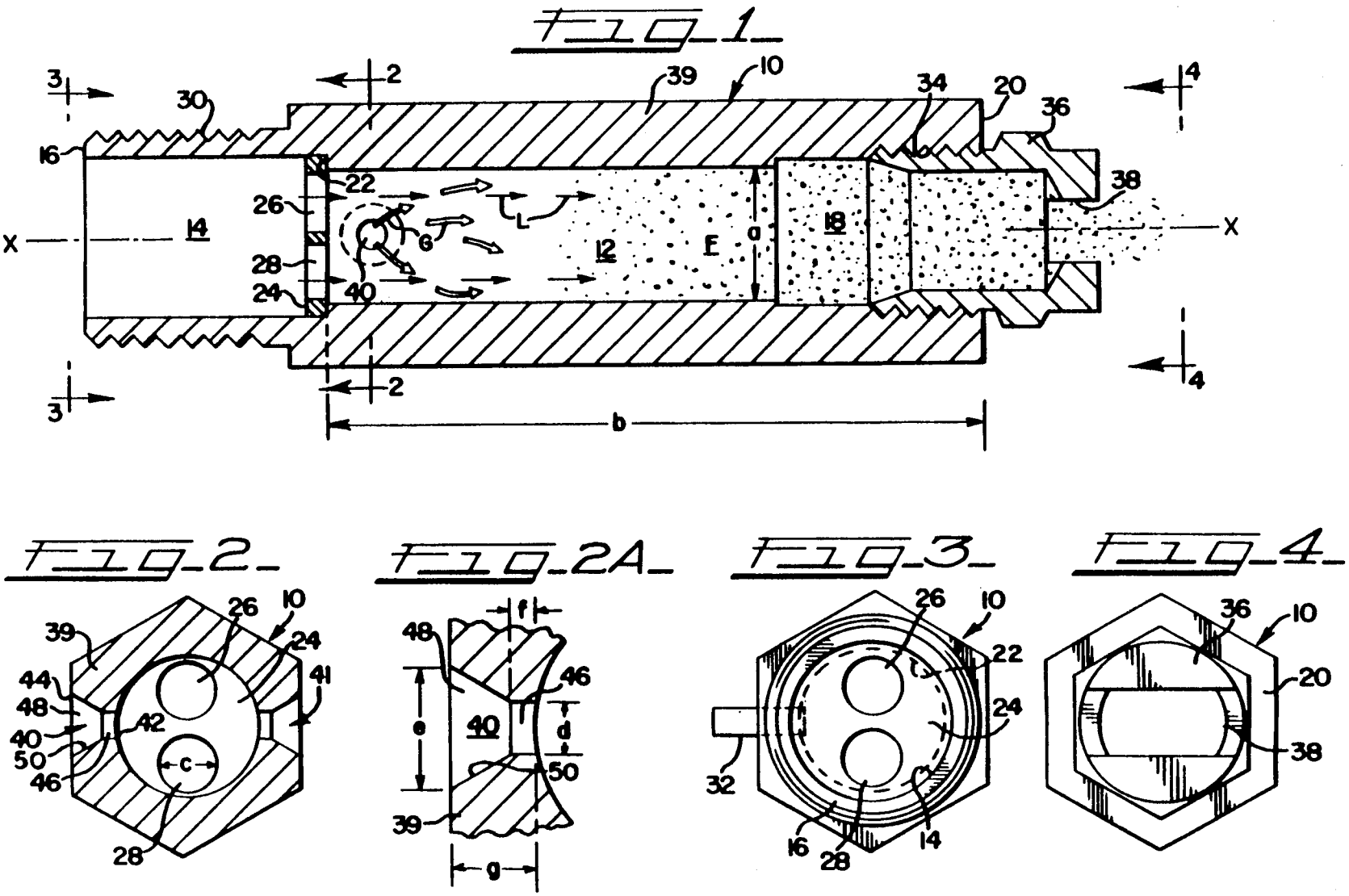
FIG. 1 is a cross sectioned side elevation view of a preferred embodiment of foam generating aspirating nozzle constructed and which operates in accordance with the principles of the present invention.
FIG. 2 is a cross sectioned end elevation view of the nozzle as viewed substantially along line 2—2 of FIG. 1.
FIG. 2A is a broken enlarged view of one of the gas inlet passages of the invention as shown in FIG. 2.
FIG. 3 is an inlet end elevation view of the nozzle as viewed substantially along line 3—3 of FIG. 1.
FIG. 4 is a discharge end elevation view of the other end of the nozzle as viewed substantially along line 4—4 of FIG. 1.

In the drawing a preferred embodiment of nozzle constructed and which operates in accordance with the principles of the method of the present invention comprises an elongate nozzle body 10 having an elongate passage, generally 12, extending therethrough. Passage 12 comprises a first passage section 14 adjacent one end 16, the inlet end, of the body, as shown in FIGS. 1 and 3, and a second passage section 18 adjacent the other foam discharge end 20 of the body, as shown in FIG. 1.

The end of the passage section 14 within the body has a shoulder 22 against which an orifice plate 24 is seated. The orifice plate 24 has a pair of openings or orifices 26 and 28 for permitting the flow of liquid foam producing agent L, such as water, therethrough from the passage section 14 and from a suitable supply conduit (not shown). The supply conduit may be attached to the end 16 of the nozzle body 10 via threads 30 and a suitable conventional coupling (not shown). Thus, the passage section 14 together with the orifice plate 24 and its orifices 26 and 28 define a liquid inlet for the liquid foam producing agent. The orifices 26 and 28 are preferably radially spaced from each other and from the axis of the elongate passage 12. The orifice plate 24 may be held in place against shoulder 22 by suitable means, such as a set screw 32 as shown in FIG. 3.

The other foam discharge end 20 of the nozzle body 10 preferably includes internal threads 34 toward the end of the passage section 18, as shown in FIG. 1, for receiving a threaded nozzle cap 36 having a foam discharge opening or orifice 38 as shown in FIGS. 1 and 4.

At least one and preferably a pair of gas inlet passages 40 and 41, as shown in FIGS. 1 and 2, pass through the wall 39 of the nozzle body 10. The gas inlet passages 40 and 41 are positioned downstream of the orifice plate 24 and extend radially through the wall 39 relative to the axis x—x of the elongate passage 12 and in a plane substantially perpendicular to the axis of the elongate passage 12. The gas inlet passages 40 and 41 also preferably extend transversely to the liquid inlet orifices 26 and 28, as shown in FIG. 2. The gas inlet passages 40 and 41 have the purpose of permitting aspiration of gas G from the exterior of the nozzle body 10 to the liquid foam producing agent L flowing through the elongate passage 12 to enhance the generation of foam F in the elongate passage 12.

In conventional foam generating nozzles the gas inlet passages are typically a simple drilled bore of constant width or diameter. However, as previously mentioned, where the flowrate of the nozzle is to be substantially increased, it has been found that such conventional straight through bores do not permit sufficient or efficient aspiration of gas to form a quality foam discharge. In the present invention, it has been discovered that if the gas inlet passages 40 and 41 are tapered at their gas inlet end adjacent the exterior surface of the nozzle body 10 so as to define a width or diameter of narrower width 42 adjacent the elongate passage 12 and a greater width or diameter 44 adjacent the exterior of the nozzle body as shown in FIG. 2, the aspiration of air and the quality of the foam is substantially improved.

More specifically, referring to FIGS. 2 and 2A, the gas inlet passages 40 and 41 are preferably formed by first drilling or boring a passage of substantially constant width or diameter dimension d equal to the minimum width 42. This is followed by counterboring the exterior of the passages 40 and 41 in a manner so that the gas inlet passages have two portions. One portion 46 is adjacent the elongate passage 12 and has a substantially constant diameter or width dimension d —— the minimum width or diameter 42. The second portion 48 has a wall 50 which tapers from the greater width or diameter 44 or dimension e to the minimum width 42 of the passage portion 46 to, in effect, form a substantially frustoconical shape as shown in FIGS. 2 and 2A.

The following Table 1 describes three nozzle Examples I–III and their preferred dimensions, pressures, and flowrates which are exemplary of the embodiments of nozzles constructed in accordance with the principles of the invention and for practicing the method of the invention.

TABLE 1

| Nozzle | Dimensions (inch) | | | | | | | Ratios | | Liquid Pressure, | Flowrate, |
|---|---|---|---|---|---|---|---|---|---|---|---|
| Example | a | b | c | d | e | f | g | d:a | d:e | psig | gpm |
| I | 0.500 | 2.650 | 0.218 | 0.106 | 0.258 | 0.056 | 0.188 | 0.212 | 0.411 | 10–200 | 2–22 |
| II | 0.625 | 3.210 | 0.276 | 0.136 | 0.280 | 0.094 | 0.219 | 0.218 | 0.486 | 10–200 | 6–40 |
| III | 0.781 | 4.018 | 0.350 | 0.150 | 0.420 | 0.063 | 0.297 | 0.192 | 0.357 | 10–200 | 10–58 |

In table 1;

a is the diameter of elongate passage 12 (See FIG. 1.

b is the gas/liquid mixing length of elongate passage 12 (See FIG. 1).

c is the diameter of the liquid inlet openings 26,28 (See FIG. 2).

d is the lesser width 42 of gas inlet passage 40, i.e. portion 46 (See FIG. 2A).

e is the greater width 44 of gas inlet passage 40, i.e. portion 48 (See FIG. 2A).

f is the length of the lesser width portion 46 of the gas inlet passage 40 (See FIG. 2A).

g is the total length of the gas inlet passage 40 (See FIG. 2A).

It will be seen that in the above Examples I–III, the ratio of the lesser width or diameter, i.e. dimension d, of the gas inlet passages 40 and 41 to the diameter of the elongate passage 12, i.e. dimension a, is fairly constant over a wide range of nozzle diameters, i.e. approximately 0.17–0.23. It will also be seen from the above examples that it is preferred that the ratio of the lesser width or diameter 42, i.e. dimension d, of the gas inlet passages 40 and 41 to the greater width 44, i.e. dimension e, of the gas inlet passages 40 and 41 is preferably between about 0.3–0.5.

The size of the aerated particles discharged by aspirating nozzles is indicative of foam quality. With deficient aspiration, the particles are relatively small, but when aeration improves, as in the nozzle of the invention, larger particles are generated. (Particle size may be represented by standard statistical parameters such as the Sauter mean or volume median diameter.)

The following Table 2 demonstrates the improved foam quality which is produced by the nozzles and method of the present invention. In Table 2 below, the 0.500 inch diameter nozzle of Table 1, Example I, was operated with ambient air as the aspirated gas and water as the liquid foam producing agent at 10, 50 and 100 psig, respectively. The nozzles compared were nozzles having a pair of gas inlet passages in which (a) one nozzle was a comparison nozzle in which the gas inlet passages were of constant width over their entire length through the thickness of the nozzle body wall 39, i.e. dimension d was 0.106 inch, and (b) the other nozzle was a nozzle of the invention having the tapered passage dimensions set forth in Table 1, Example I. Otherwise both nozzles were identical. The parameters as follows were measured for 60 seconds at a distance of 6 feet from the nozzle discharge.

TABLE 2

| Parameter Observed* | Pressure, psig | Comparison Nozzle | Invention Nozzle |
|---|---|---|---|
| Sauter Mean | 10 | 734 | 793 |
| Diameter ($\bar{D}_{32}$), μm | 50 | 1015 | 1068 |
| | 100 | 835 | 925 |
| Volume Median | 10 | 970 | 974 |
| Diameter ($D_{V0.5}$), μm | 50 | 1303 | 1419 |
| | 100 | 1125 | 1245 |
| 90% - Volume | 10 | 1129 | 1187 |
| Diameter ($D_{40.9}$), μm | 50 | 1679 | 1772 |
| | 100 | 1569 | 1735 |

*See Standard Practice for Determining Data Criteria and Processing for Liquid Drop Size Analysis ASTM E799-87 and Standard Terminology Relating to Liquid Particle Statistics ASTM E1296-90.

At 10 psig the liquid flowrates of the conventional and invention nozzles were 6.2 and 6.4 gpm, respectively; at 50 psig they were 13.5 and 13.6 gpm, respectively; and at 100 psig they were 19.0 and 19.2 gpm, respectively.

It will be seen from the above Table 2 that all of the parameters indicative of foam quality were improved, and some substantially improved, in the nozzle of the invention.

Having considered the above description, it is believed that the operation of the foam generating aspirating nozzle of the present invention will be evident. However, for purposes of clarity, the operation of the nozzle and the method of the invention will be briefly described to follow.

A source of liquid foam producing agent, such as water, is coupled to the end 16 of the nozzle body 10 and this liquid is supplied to the plate 24 under suitable pressures and flow rates, for example, as shown in the foregoing table. As the liquid foam producing agent passes through the orifices or openings 26 and 28 in the plate 24, it will be formed into streams L which flow axially of the elongate passage 12. These liquid streams L jet past the gas inlet passages 40 and 41 resulting in a reduction in pressure at the gas inlet passages. This pressure drop will aspirate gas G through the passages 40 and 41 from the exterior of the nozzle body 10. The gas G is intimately mixed with the liquid L in the elongate passage 12 to form a high quality foam F having a large number of air filled bubbles to greatly increase the surface area of the liquid. This enhanced bubbled foam is ultimately discharged through the foam discharge orifice 38 in the nozzle cap 36.

It will be understood that numerous modifications may be made by those skilled in the art without departing from the true spirit and scope of the invention, the above described embodiments of the present invention being merely illustrative of an application of the principles of the invention.

We claim:

1. A foam generating nozzle comprising:

a nozzle body having an exterior and an elongate passage therein having ends spaced from each other;

a liquid inlet adjacent one end of said elongate passage for introducing a liquid foam producing agent to flow axially through said elongate passage;

at least one gas inlet passage through said nozzle body between said liquid inlet and the other end of said elongate passage for aspirating a gas into said passage when said liquid foam producing agent is flowing through said elongate passage, said gas inlet passage extending in a plane substantially perpendicular to the axis of the axially flowing liquid foam production agent and having a first width adjacent said elongate passage, a second width greater than said first width adjacent the exterior of said body, and a wall extending between said widths; and foam discharge means adjacent said other end of said elongate passage for discharging the foam therefrom.

2. The nozzle of claim 1, wherein said elongate passage extends axially between the ends of said passage.

3. The nozzle of claim 1, wherein said liquid inlet comprises at least one orifice for discharging the liquid foam producing agent into the elongate passage to flow past said gas inlet passage.

4. The nozzle of claim 1, wherein said liquid inlet comprises a pair of orifices for discharging liquid foam producing agent into the elongate passage to flow axially through said elongate passage and past said gas inlet passages, said orifices being spaced radially from each other and from the axis of said elongate passage.

5. The nozzle of claim 4, including a pair of said gas inlet passages extending radially relative to the axis of said elongate passage.

6. The nozzle of claim 5, wherein said gas inlet passages are positioned transversely from said pair of orifices.

7. The nozzle of claim 1, including a pair of said gas inlet passages extending radially relative to the axis of said elongate passage.

8. The nozzle of claim 1, wherein said liquid inlet comprises a plate positioned at said one end of said elongate passage, said plate having a plurality of orifices therein radially spaced from the axis of said elongate passage.

9. The nozzle of claim 1, wherein said wall of said gas inlet passage tapers between said first and second widths.

10. The nozzle of claim 1, wherein said gas inlet passage comprises two portions, one portion extending radially outwardly from said elongate passage and having a width which is substantially constant over a length thereof and said width thereof is said first width, the second portion having said second width.

11. The nozzle of claim 10, wherein said second portion comprises said wall, said wall tapering between said first portion and said second width adjacent the exterior of said body.

12. The nozzle of claim 11, wherein said second portion is frustoconical.

13. The nozzle of claim 11, wherein the ratio of said first width to the cross sectional width of said elongate passage is approximately 0.17–0.23.

14. The nozzle of claim 11, wherein the ratio of said first width to said second width is approximately 0.3–0.5.

15. The nozzle of claim 10, wherein the ratio of said first width to the cross-sectional width of said elongate passage is approximately 0.17–0.23.

16. The nozzle of claim 15, wherein the ratio of said first width to said second width is approximately 0.3–0.5.

17. The nozzle of claim 10, wherein the ratio of said first width to said second width is approximately 0.3–0.5.

18. A method of generating foam comprising:

discharging a liquid foam producing agent into an elongate passage to flow axially therein;

flowing said liquid foam producing agent past a gas inlet passage which extends in a plane which is substantially perpendicular to the axis of the axially flowing liquid foam producing agent and which has a wall which tapers between a first width adjacent the flowing liquid foam producing agent and a second width which is greater than said first width and which is spaced from said flowing liquid foam producing agent; and aspirating a gas into said flowing liquid foam producing agent through the tapered gas inlet passage to discharge the gas into the flowing liquid foam producing agent at the first width of the gas inlet passage.

19. The method of claim 18, wherein the liquid foam producing agent is discharged into the elongate passage through a pair of radially spaced orifices, and the discharged liquid foam producing agent is flowed past a pair of tapered gas inlet passages which are downstream of said orifices and are positioned transversely therefrom.

20. The method of claim 18, wherein the gas inlet passage comprises two portions, one portion extending radially outwardly from the elongate passage and having a width which is substantially constant over a length thereof and said width thereof is said first width, the second portion having said second width, and the gas is aspirated respectively through said second portion and then said one portion.

21. The method of claim 20, wherein said second portion comprises a wall which tapers between said first portion and said second width adjacent an exterior of said body.

22. The method of claim 21, wherein said second portion is frustoconical.

23. The method of claim 18, wherein the ratio of the first width to the cross-sectional width of the elongate passage is approximately 0.17–0.23.

24. The method of claim 23, wherein the ratio of the first width to the second width is approximately 0.3–0.5.

25. The method of claim 18, wherein the ratio of the first width to the second width is approximately 0.3–0.5.

26. The method of claim 18, wherein said liquid foam producing agent is water.

* * * * *

UNITED STATES PATENT AND TRADEMARK OFFICE

CERTIFICATE OF CORRECTION

PATENT NO. : 5,058,809

DATED : October 22, 1991

INVENTOR(S) : Daniel L. Carroll and Timothy C. Shannon

It is certified that error appears in the above-identified patent and that said Letters Patent is hereby corrected as shown below:

On the title page, [Item] 73 Assignee should be -- Delavan Inc -- without a period.

In column 2, line 46, delete "cross sectioned" and insert -- cross-sectioned --.

In column 2, line 50, delete "cross sectioned" and insert -- cross-sectioned --.

In column 4, line 25, after "FIG. 1" and before the period, insert -- ) --.

In column 5, line 14 delete "$(D_{40.9})$" and insert -- $(D_{V0.9})$ --.

UNITED STATES PATENT AND TRADEMARK OFFICE

CERTIFICATE OF CORRECTION

PATENT NO. : 5,058,809

DATED : October 22, 1991

INVENTOR(S) : Daniel L. Carroll and Timothy C. Shannon

It is certified that error appears in the above-identified patent and that said Letters Patent is hereby corrected as shown below:

In column 6, claim 13, line 55, delete "cross sectional" and insert -- cross-sectional--.

Signed and Sealed this

Ninth Day of March, 1993

*Attest:*

STEPHEN G. KUNIN

*Attesting Officer*

*Acting Commissioner of Patents and Trademarks*